US006035272A

United States Patent [19]

Nishimura et al.

[11] Patent Number: 6,035,272

[45] Date of Patent: Mar. 7, 2000

[54] METHOD AND APPARATUS FOR SYNTHESIZING SPEECH

[75] Inventors: Hirofumi Nishimura, Yokohama; Toshimitsu Minowa, Chigasaki; Yasuhiko Arai, Yokohama, all of Japan

[73] Assignee: Matsushita Electric Industrial Co., Ltd., Osaka, Japan

[21] Appl. No.: 08/897,830

[22] Filed: Jul. 21, 1997

[30] Foreign Application Priority Data

Jul. 25, 1996 [JP] Japan ..... 8-196635

[51] Int. Cl.[7] ..... G10L 5/04

[52] U.S. Cl. ..... 704/258; 704/260

[58] Field of Search ..... 704/258, 254, 704/255, 260, 268

[56] References Cited

U.S. PATENT DOCUMENTS

| | | | |
|---|---|---|---|
| 5,220,629 | 6/1993 | Kosaka et al. | 704/260 |
| 5,463,713 | 10/1995 | Hasegawa | 704/260 |
| 5,615,300 | 3/1997 | Hara et al. | 704/260 |
| 5,715,368 | 2/1998 | Saito et al. | 704/268 |
| 5,758,320 | 5/1998 | Asano | 704/258 |
| 5,845,047 | 12/1998 | Fukuda et al. | 704/268 |

FOREIGN PATENT DOCUMENTS

| | | |
|---|---|---|
| 0749109 | 12/1996 | European Pat. Off. . |
| 1-284898 | 11/1989 | Japan . |
| 6-250691 | 9/1994 | Japan . |
| 7-152392 | 6/1995 | Japan . |
| 7-319497 | 12/1995 | Japan . |
| 8-63190 | 3/1996 | Japan . |

OTHER PUBLICATIONS

Takao Koyama et al. "*Speech Synthesis by Rule Based in VCV Waveform Synthesis Units*" 1996 PP. 53–60.

*Primary Examiner*—David R. Hudspeth
*Assistant Examiner*—Martin Lerner
*Attorney, Agent, or Firm*—Lowe Hauptman Gopstein Gilman & Berner

[57] ABSTRACT

A speech synthesizing apparatus for deforming and connecting speech pieces to synthesize speech has a speech waveform database for storing data of an accent type of a speech piece of a word or a syllable uttered with type-0 accent and type-1 accent, data of phonemic transcription of the speech piece and data of a position at which the speech piece can be segmented, an input buffer for storing a character string of phonemic transcription and prosody of speech to be synthesized, a synthesis unit selecting unit for retrieving candidates of speech pieces from the speech waveform database on the basis of the character string of phonemic transcription in the input buffer, and a used speech piece selecting unit for determining a speech piece to be practically used among the retrieved candidates according to an accent type of speech to be synthesized and a position in the speech at which the speech piece is used, thereby preventing degradation of a quality of sound when the speech piece is processed.

6 Claims, 10 Drawing Sheets

FIG. 3

| | SPEECH PIECE APPLYING POSITION / SPEECH PIECE EXTRACTING POSITION | WORD HEAD | POSITION BEFORE ACCENT KERNEL | POSITION OF ACCENT KERNEL | POSITION AFTER ACCENT KERNEL |
|---|---|---|---|---|---|
| FOR ACCENT TYPES OTHER THAN TYPE −1 ACCENT | START | 01 | 02 | 11 | 12 |
| | END | 0* | 0* | 10 | 10 |
| FOR TYPE −1 ACCENT | START | 11 | | | 12 |
| | END | 10 | | | 10 |

FIG. 7

| | |
|---|---|
| CV AT THE HEAD OF WORD | aaaa ( TYPE – 0 ) , aaaa ( TYPE – 1 ) , iiii ( TYPE – 0 ) , iiii ( TYPE – 1 ) , uuuu ( TYPE – 0 ) , ····· |
| VCV IN THE MIDDLE AND AT THE END OF WORD | akaaka ( TYPE – 0 ) , akaaka ( TYPE – 1 ) , akiaki ( TYPE – 0 ) , akiaki ( TYPE – 1 ) , akuaku ( TYPE – 0 ) , ····· ikaika ( TYPE – 0 ) , ikaika ( TYPE – 1 ) , ikiiki ( TYPE – 0 ) , ikiiki ( TYPE – 1 ) , ikuiku ( TYPE – 0 ) , ····· |
| VNCV ( FOR SYLLABLIC NASAL ) | an'kaan'ka ( TYPE – 0 ) , an'kaan'ka ( TYPE – 1 ) , an'kian'ki ( TYPE – 0 ) , an'kian'ki ( TYPE – 1 ) , an'kuan'ku ( TYPE – 0 ) , ····· |

FIG. 10

| SPEECH PIECE APPLYING POSITION | THE 1ST SYLLABLE TO THE 2ND SYLLABLE | VCV IN A POSITION BEFORE ACCENT KERNEL | VCV FROM A POSITION OF ACCENT KERNEL TO THE NEXT SYLLABLE | VCV IN A POSITION AFTER ACCENT KERNEL |
|---|---|---|---|---|
| ACCENT OTHER THAN TYPE-1 | TYPE 0 | TYPE 1 | TYPE 2 | TYPE 3 |
| ACCENT FOR TYPE-1 | TYPE 2 | | | TYPE 3 |

METHOD AND APPARATUS FOR SYNTHESIZING SPEECH

BACKGROUND OF THE INVENTION (1) Field of the Invention

The present invention relates to a method and an apparatus for synthesizing speech, in particular, to a method and an apparatus for synthesizing speech in which a text is converted into speech.

(2) Description of the Related Art

Speech synthesizing methods for synthesizing speech by connecting speech pieces heretofore use speech in various accent types in a database of speech pieces without paying particular attention the accent types as disclosed in, for example, "Speech Synthesis By Rule Based On VCV Waveform Synthesis Units", The Institute of Electronics Information and Communication Engineers, SP 96-8.

However, if a pitch frequency of speech to be synthesized is largely different from a pitch frequency of a speech piece stored in the database, general speech synthesizing methods have a drawback that a quality of sound is degraded when the pitch frequency of the speech piece is corrected.

An object of the present invention is to provide a method and an apparatus for synthesizing speech, which can minimize degradation of sound when the pitch frequency is corrected.

SUMMARY OF THE INVENTION

The present invention therefore provides a speech synthesizing method comprising the steps of accumulating a number of words or syllables uttered with type-0 accent and type-1 accent with phonemic transcription thereof in a waveform database, segmenting speech of the words or syllables immediately before a vowel steady section or an unvoiced consonant to extract a speech piece, retrieving candidates for speech to be synthesized on the basis of phonemic transcription of the speech piece from the waveform database when the speech piece is deformed and connected to synthesize the speech, and determining which retrieved speech piece uttered with the type-0 accent or with the type-1 accent is used according to an accent type of the speech to be synthesized and a position in the speech to be synthesized at which the speech piece is used.

According to the speech synthesizing method of this invention, it is possible to select a speech piece whose pitch frequency and pattern of variation with time are similar to those of speech to be synthesized without carrying out complex calculations so as to minimize degradation in quality of sound due to a change of the pitch frequency. In consequence, synthesized speech in a high quality is available.

In the speech synthesizing method of this invention, the longest matching method may be applied when the candidates for the speech to be synthesized are retrieved from the waveform database.

In the speech synthesizing method of this invention, the waveform database may be configured with speech of words each obtained by uttering a two-syllable sequence or a three-syllable sequence with the type-0 accent and the type-1 accent two times. It is therefore possible to efficiently configure the waveform database almost only with phonological unit sequences of VCV or VVCV (V represents a vowel or a syllablic nasal, and C represents a consonant).

The present invention also provides a speech synthesizing apparatus comprising a speech waveform database for storing data representing an accent type of a speech piece of a word or a syllable uttered with type-0 accent and type-1 accent, data representing phonemic transcription of the speech piece and data indicating a position at which the speech piece can be segmented, a means for storing a character string of phonemic transcription and prosody of speech to be synthesized, a speech piece candidate retrieving means for retrieving candidates of speech pieces from the speech waveform database on the basis of the character string of phonemic transcription stored in the storing means, and a means for determining a speech piece to be practically used among the retrieved candidates according to an accent type of speech to be synthesized and a position in the speech at which the speech piece is used.

According to this invention, it is possible to obtain synthesized speech in high quality with a small quantity of calculations.

In the speech synthesizing apparatus of this invention, the speech waveform database may be configured with speech of words each obtained by uttering a two-syllable sequence or a three-syllable sequence with the type-0 accent and the type-1 accent two times. It is therefore possible to efficiently configure the speech waveform database and reduce a size thereof.

BRIEF DESCRIPTION OF THE DRAWINGS

FIG. 3 is a diagram showing contents of a retrieval rule table in the speech synthesizing apparatus in FIG. 2 according to the second embodiment;

FIG. 7 is a diagram showing speech pieces stored in the speech waveform database according to a third embodiment of this invention;

FIG. 10 is a diagram showing a retrieval table according to the third embodiment.

DESCRIPTION OF THE PREFERRED EMBODIMENTS

Now, description will be made of embodiments of this invention with reference to the drawings.

(1) First Embodiment

FIGS. 1A through 1D are diagrams showing a manner of selecting speech pieces in a speech synthesizing method according to the first embodiment of this invention. According to this embodiment, a great number of words or minimal phrases uttered with type-0 accent and type-1 accent are accumulated with their phonemic transcription (phonetic symbols, Roman characters, kana characters, etc.) in a waveform database. Speech of the words or minimal phrases is segmented immediately before a vowel steady section or an unvoiced consonant into speech pieces so that each speech piece can be extracted. Phonemic transcription of the speech piece is retrieved on the basis of phonemic transcription of speech to be synthesized in, for example, the longest matching method. Then, whether the type-1 accent or the type-0 accent is applied to the retrieved speech piece is determined according to an accent type of the speech to be synthesized and a position at which the retrieved speech piece is used in the speech to be synthesized.

Referring to FIG. 1, the speech synthesizing method according to this embodiment will be described by way of an example. This example illustrates a manner of selecting speech pieces when "yokohamashi" is synthesized. First, on the basis of phonemic transcription of "yokohamashi" shown in FIG. 1A, a length of a speech piece is determined in the database in the longest matching method or the like. In this example, a speech piece "yokohama" of "yokohamaku" matches in the database. Next, whether the type-0 accent or the type-1 accent is applied to the speech piece "yokohama" is determined according to pitch fluctuation. FIG. 1B shows fluctuation of a pitch frequency of "yokohamaku" uttered with the type-1 accent, whereas FIG. 1C shows fluctuation of a pitch frequency of "yokohamaku" uttered with the type-0 accent. Here, Roman characters are used as phonemic transcription. A pitch frequency of "yokohamashi" uttered with the type-0 accent increases at "yo" as indicated by a solid line in FIG. 1A. Accordingly, here is used a portion from the first syllable "yo" of "yokohamaku" uttered with the type-0 accent having a rising frequency to immediately before a consonant of the fifth syllable "ku". An accent kernel lies in "ashi" so that the pitch frequency drops during that. Therefore, "ashi" of "ashigara" uttered with, not the type-0 accent shown in FIG. 1E, but the type-1 accent shown in FIG. 1D is used. As this, a speech piece whose pitch frequency is the closest to that of speech to be synthesized and its phonemic transcription matches is selected.

(2) Second Embodiment

Figure 1A:
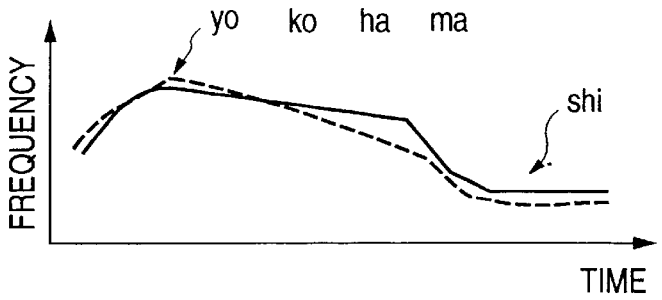
FIGS. 1A through 1E are diagrams showing a manner of selecting speech pieces when speech is synthesized according to a first embodiment of this invention.
Figure 1B:
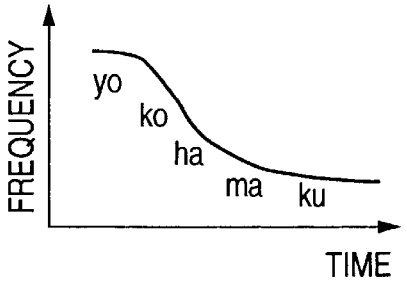
Figure 1C:
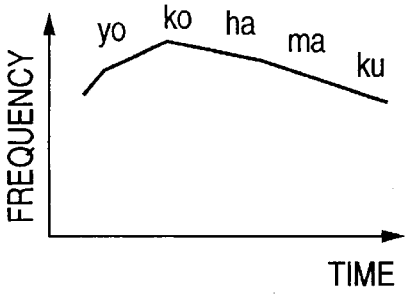
Figure 1D:
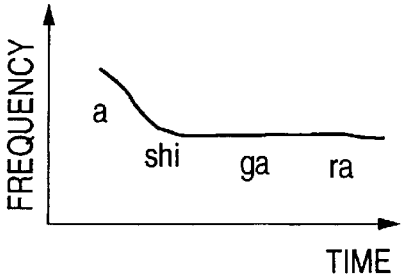
Figure 1E:
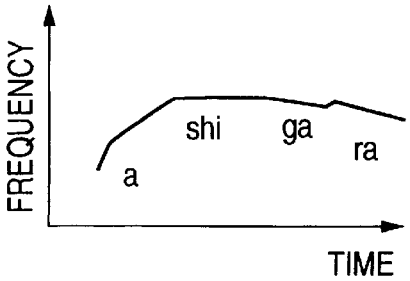
Figure 2:
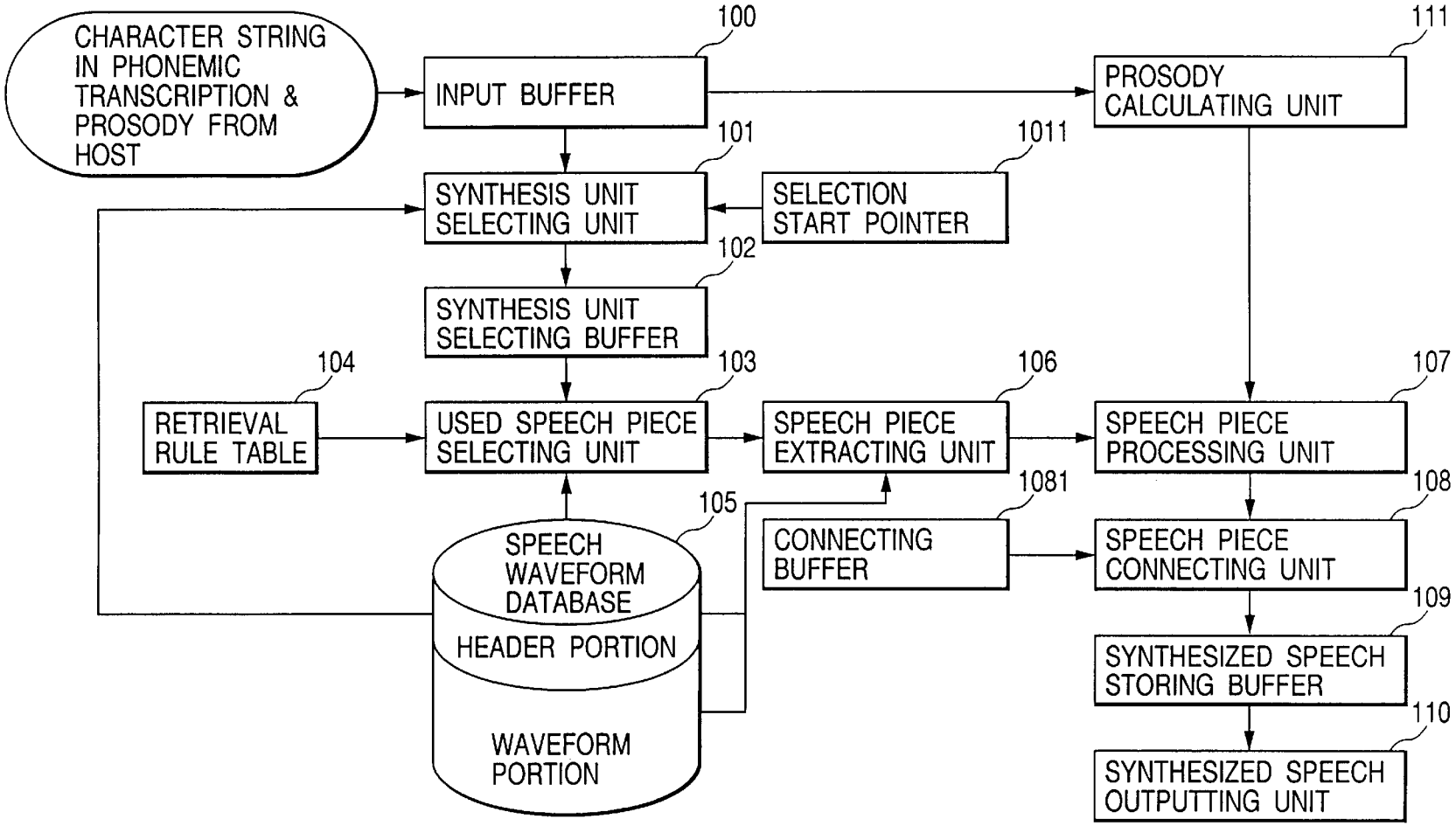
FIG. 2 is a block diagram showing a structure of a speech synthesizing apparatus according to a second embodiment of this invention.

FIG. 2 is a block diagram showing a structure of a speech synthesizing apparatus according to a second embodiment of this invention. In FIG. 2, reference numeral 100 denotes an input buffer for storing a character string expressed in phonemic transcription and prosody thereof such as an accent type, etc., supplied from a host computer's side. Reference numeral 101 denotes a synthesis unit selecting unit for retrieving a synthesis unit from the phonemic transcription, and 1011 denotes a selection start pointer for indicating from which position of the character string stored in the input buffer 100 retrieval of a speech piece to be a synthesis unit should be started. Reference numeral 102 denotes a synthesis unit selecting buffer for holding information of the synthesis unit selected by the synthesis unit selecting unit 101, 103 denotes a used speech piece selecting unit for determining a speech piece on the basis of a retrieval rule table 104, 105 denotes a speech waveform database configured with words or minimal phrases uttered with the type-0 accent and the type-1 accent, 106 denotes a speech piece extracting unit for practically extracting a speech piece from header information stored in the speech waveform database 105, 107 denotes a speech piece processing unit for matching the speech piece extracted by the speech piece extracting unit 106 to prosody of speech to be synthesized, 108 denotes a speech piece connecting unit for connecting the speech piece processed by the speech piece processing unit 107, 1081 denotes a connecting buffer for temporarily storing the processed speech piece to be connected, 109 denotes a synthesized speech storing buffer for storing synthesized speech outputted from the speech piece connecting unit 108, 110 denotes a synthesized speech outputting unit, and 111 denotes a prosody calculating unit for calculating a pitch frequency and a phonological unit duration of the synthesized speech from the character string and the prosody stored in the input buffer 100 and outputting them to the speech piece processing unit 107.

FIG. 3 shows contents of the retrieval rule table 104 shown in FIG. 2. According to the retrieval rule table 104, a speech piece is determined among speech piece units selected as candidates by the synthesis unit selecting unit 101. First, depending on whether speech to be synthesized is with the type-1 accent or with the type-0 accent and which position in the speech to be synthesized a relevant speech piece is used, a column to be referred to is determined. A column of "start" indicates a position at which extraction of a speech piece is started. A column of "end" indicates an end position of a retrieval region in the longest matching method when a speech piece is extracted. Numerical values in the table each consists of two figures. When a figure located at tens unit is 0, the speech piece is extracted from speech uttered with the o-type accent. When 1, the speech piece is extracted from speech uttered with the type-1 accent. A figure located at ones unit indicates a position of a syllable of speech. When the figure located at the ones unit is 1, the position of the syllable is in the first syllable. When 2, the position is in the second syllable. Incidentally, 0 in the column of "end" stands for that up to the last syllable of a minimal phrase is included in the retrieval region in the longest matching method, whereas "*" stands for that phonemic transcription up to a position where an accent kernel of speech to be synthesized is not included becomes an object of the retrieval.

Figure 4:
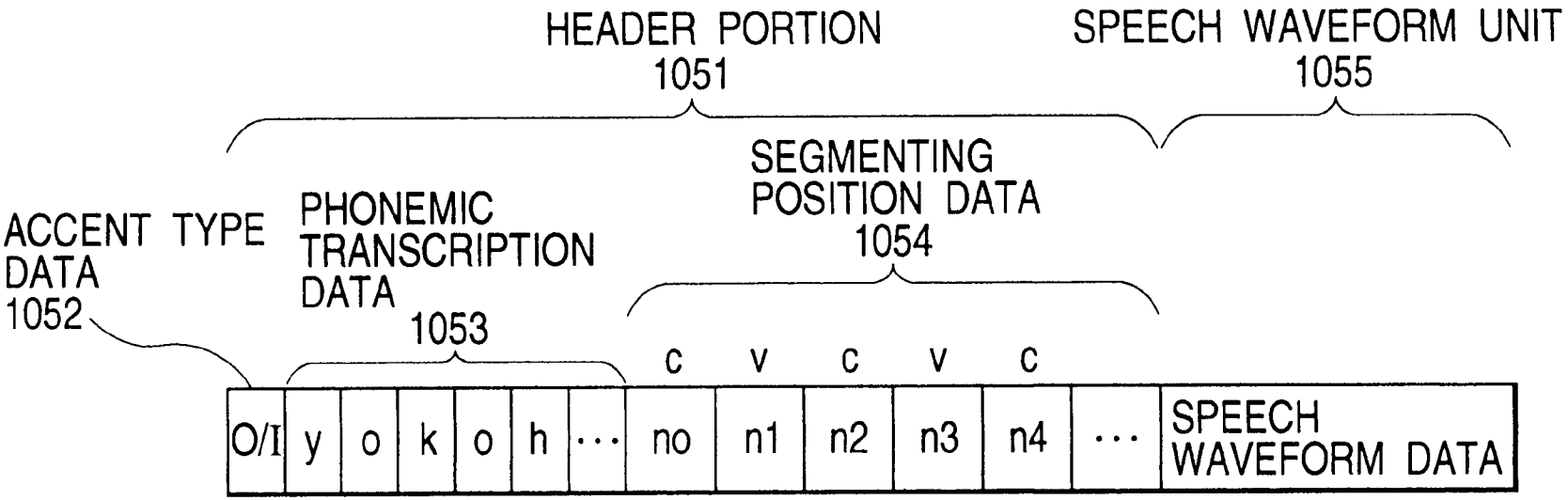
FIG. 4 is a diagram showing a data structure of a speech piece registered in a speech waveform database in the speech synthesizing apparatus in FIG. 2 according to the second embodiment.

FIG. 4 shows a data structure of the speech waveform database 105. In a header portion 1051, there are stored data 1052 showing an accent type (type-0 or -1) upon uttering speech, data 1053 showing phonemic transcription of the registered speech, and data 1054 showing a position at which the speech can be segmented as a speech piece. In a speech waveform unit 1055, there is stored speech waveform data before extracting a speech piece.

Figure 5:
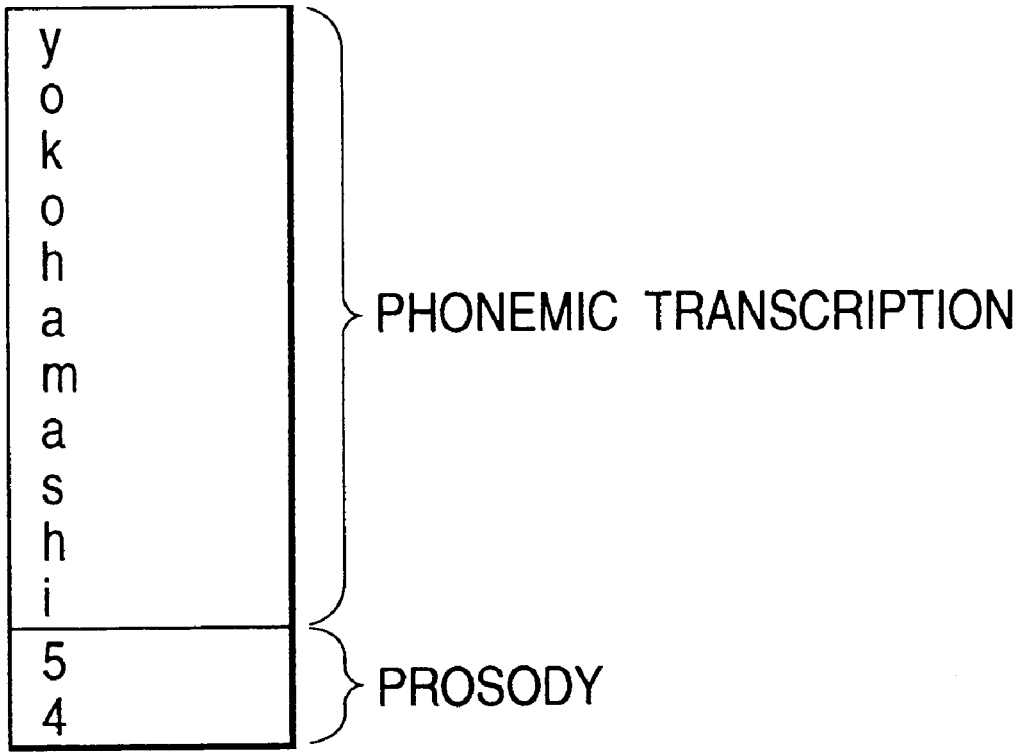
FIG. 5 is a diagram showing a structure of information to be stored in an input buffer in the speech synthesizing apparatus in FIG. 2 according to the second embodiment.

FIG. 5 shows a data structure of the input buffer 100. Phonemic transcription is inputted as a character string into the input buffer 100. Further, prosody as to the number of morae and an accent type is also inputted as numerical figures in the input buffer 100. Roman characters are used as phonemic transcription. Two figures represent prosody, where a figure located at tens unit represents the number of morae of a word, whereas a figure located at ones unit represents an accent type.

Figure 6:
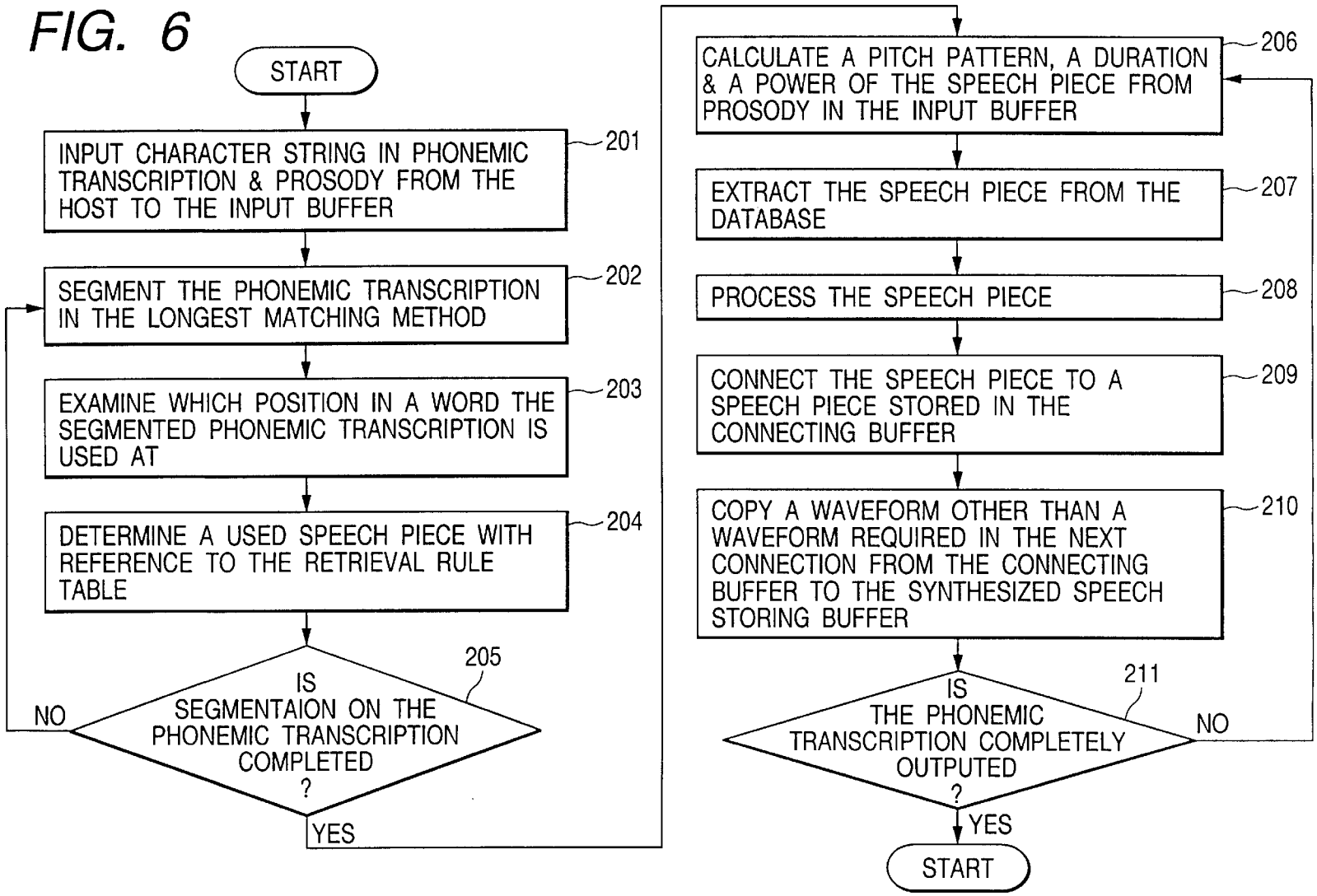
FIG. 6 is a flowchart for illustrating an operation of the speech synthesizing apparatus in FIG. 2 according to the second embodiment.
Figure 8A:
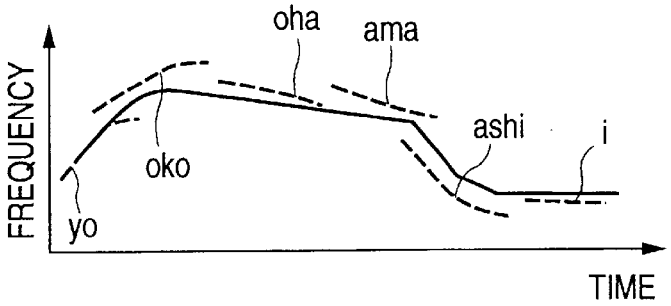
FIGS. 8A through 8C are diagrams showing a manner of selecting speech pieces when speech is synchronized according to the third embodiment.
Figure 8B:
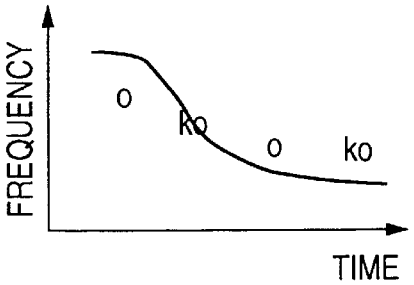
Figure 8C:
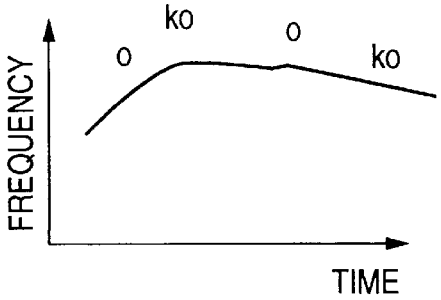
Figure 9:
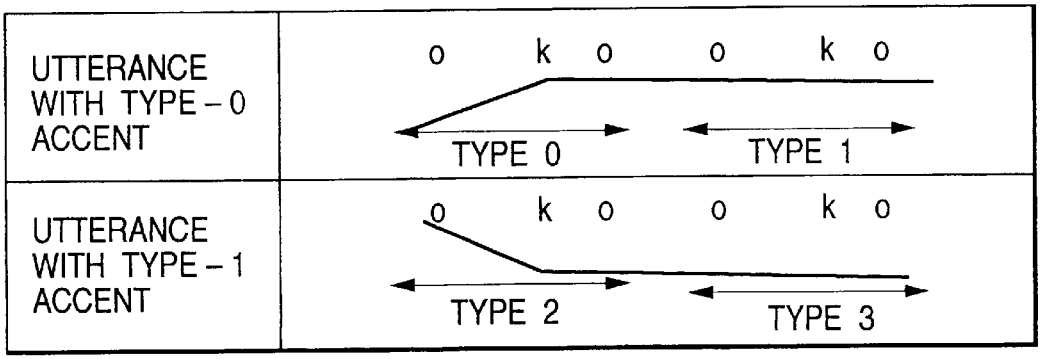
FIG. 9 is a diagram showing types of utterance of a speech piece according to the third embodiment.

Next, an operation of the speech synthesizing apparatus according to this embodiment will be described with reference to a flowchart shown in FIG. 6. First, a character string in phonemic transcription and prosody thereof are inputted to the input buffer 100 from the host computer (Step 201). Next, the phonemic transcription is segmented in the longest matching method (Step 202). It is then examined which position in a word the segmented phonemic transcription is used at (Step 203). If the character string in phonemic transcription (using Roman characters, here) stored in the input buffer 101 is, for example, "yokohamashi", words starting with "yo" are retrieved in a group of phonemic transcription stored in the header portions 1051 in the speech waveform database 105 by the synthesis unit selecting unit 101. In this case, "yo" of "yokote" and "yo" of "yokohamaku" are retrieved, for example. Next, a check is made on whether the second character "ko" of the character string of "yokohamashi" matches to each of "ko" of the retrieved words or not. This time, "yoko" of "yokohamaku" is chosen. The retrieval is progressed in a similar manner, and, finally, "yokohama" is selected as a candidate for the synthesis unit. Since this "yokohama" is the first speech piece of "yokohamashi" and "yokohamashi" is with an accent type (a type-4 accent) other than the type-1 accent, the synthesis unit selecting unit 101 examines the columns of word head, start and end for an accent type other than type-1 in the retrieval rule table 104, and selects the first syllable to the fourth syllable of "yokohamaku" uttered in the type-0 accent as a candidate for extraction. This information is fed to the used speech piece selecting unit 103. The used speech piece selecting unit 103 examines the segmenting position data 1054 of the first syllable and the fourth syllable of "yokohamaku" uttered in the type-0 accent stored in the header portion 1051 of the speech waveform database 105, and sets a start point of waveform extraction to the head of "yo" and an end point of the waveform extraction to before an unvoiced consonant (Step 204). At this point of time, the selection start pointer 1011 points "s" of "shi". The above process is conducted on all segmented phonemic transcription (Step 205). On the other hand, the prosody calculating unit 111 calculates a pitch pattern, a duration and a power of the speech piece from the prosody stored in the input buffer 100 (step 206). The speech piece selected by the used speech piece selecting unit 103 is fed to the speech piece extracting unit 106 where a waveform of the speech piece is extracted (Step 207), fed to the speech piece processing unit 107 to be 50 processed as to match to a desired pitch frequency and phonological unit duration calculated by the prosody calculating unit 111 (Step 208), then fed to the speech piece connecting unit 108 to be connected (Step 209). If the speech piece is the head of the minimal phrase, there is no object to which the speech piece is connected. For this, the speech piece is stored in the connecting buffer 1081 to prepare for being connected to the next speech piece, then outputted to the synthesis speech storing buffer 109 (Step 210). Next, since the selection start pointer 1011 of the input buffer 100 points to "s" of "shi", the synthesis unit selecting unit 101 retrieves words or minimal phrases including "shi" in the group of phonemic transcription in the header portion 1051 in the waveform database 105. After that, the above operation is repeatedly conducted in a similar manner so as to synthesize speech (Step 211).

(3) Third Embodiment

Next, description will be made of a third embodiment of this invention referring to FIGS. 7 through 10. According to the third embodiment, the speech waveform database 105 shown in FIG. 2 stores syllables for word heads, vowel-consonant-vowel (VCV) sequences and vowel-nasal-consonant-vowel (VNCV) sequences which are uttered two times with the type-1 accent and type-0 accent. Here, a waveform extracting position is at only a vowel steady section. Now, a manner of selecting speech upon synthesizing "yokohamashi" will be described with reference to FIGS. 8A through 8C. Here, Roman characters are used as phonemic transcription.

A sequence waveform of two syllables "yoyo" uttered with the type-1 accent and the type-0 accent exists in the speech waveform database 105, and an accent type of speech to be synthesized is with the 4-type accent so that the head of the word has the same pitch fluctuation as the type-0 accent. Therefore, here is selected "yo" in the first syllable of "yoyoyo" uttered with the type-0 accent.

As to the next "oko", there are two types of "oko" as the former half and the latter half of a word "okooko" uttered with the type-0 accent and the type-1 accent, totaling 4 types of "oko". A pitch frequency of the speech to be synthesized has a pitch fluctuation rising between these speech pieces, that is, "yo" and "oko". Here is thus selected the first "oko" (type 0) in FIG. 9 of "okooko" uttered with the type-0 accent, which is the closest to a pitch frequency of the speech to be synthesized.

As to the next "oha", a pitch frequency is high during that. For this, among four types of "oha" obtained from "ohaoha" uttered with the type-0 accent and the type-1 accent, the second "oha" (type 1) of "ohaoha" uttered with the type-0 accent whose pitch frequency is high is selected because it is the closest to the pitch frequency of the speech to be synthesized. Similarly to the case of "oha", the second "ama" of "amaama" uttered with the type-0 is selected.

As to "ashi", the pitch frequency drops during "ashi" since "yokohamashi" is with the type-4 accent. For this, among four types of "ashi" obtained from "ashiashi" uttered with the type-0 accent and type-1 accent, here is selected the first "ashi" (type 2) of "ashiashi" uttered with the type-1 accent whose pitch frequency drops since it is the closest to the pitch frequency of the speech to be synthesized. Speech pieces selected as above are processed and connected to synthesize the speech.

In this example, the speech waveform database is configured with words each obtained by uttering two syllables or three syllables two times. However, this invention is not limited to this example, but it is possible to configure the database with sets of accent types other than the type-0 accent and type-1 accent such that speech of two-syllable sequence is uttered with type-3 accent to obtain a speech piece in the type-0 from the former half and a speech piece in the type-1 from the latter half. Further, the above embodiment can be realized by using a synthesis unit extracted from speech uttered inserting suitable speech before and after a two-syllable sequence or a three-syllable sequence.

According to this embodiment, speech to be the database is obtained by uttering a word consisting of a two-syllable sequence or three-syllable sequence two times with the type-0 accent or the type-1 accent so that totaling four types of VCV speech pieces shown in FIG. 5 always exist in the database with respect to one VCV phonemic transcription. Therefore, all speech pieces necessary to cover variation in time of the pitch frequency of speech to be synthesized can be prepared. Meanwhile, as to the speech piece selecting rule, it is possible to simply segment phonemic transcription into VCV units to determine a speech piece using a retrieval table shown in FIG. 10 without applying the longest matching method.

What is claimed is:

1. A speech synthesizing method comprising the steps of for a plurality of words or syllables, accumulating in a waveform database a plurality of speech waveforms of each word or syllable, including a first speech waveform of the word or syllable uttered with a type-0 accent and a second speech waveform of the word or syllable uttered with a type-1 accent, with a phonemic transcription of the word or syllable, one of the speech waveforms of the word or syllable corresponding to a correct utterance of the word or syllable to be synthesized, and another of the speech waveforms of the word or syllable corresponding to an incorrect utterance of the word or syllable to be synthesized;

segmenting the speech waveform of each word or syllable uttered with the type-0 accent immediately before a vowel steady section or an unvoiced consonant of the speech waveform to extract a plurality of speech pieces derived from the type-0 accent;

segmenting the speech waveform of each word or syllable uttered with the type-1 accent immediately before a vowel steady section or an unvoiced consonant of the speech waveform to extract a plurality of speech pieces derived from the type-1 accent;

retrieving a plurality of type-0 accent candidates and type-1 accent candidates for a series of used speech pieces expressing a phonemic transcription of a remarked speech to be synthesized and an accent type of the remarked speech from the waveform database according to the phonemic transcription of the remarked speech to be synthesized;

for each of the used speech pieces, determining the used speech piece as either a type-0 accent candidate or a type-1 accent candidate according to the accent type of the remarked speech to be synthesized and a position of the used speech piece in the remarked speech to be synthesized; and synthesizing the remarked speech by connecting the used speech pieces to each other to produce a series of used speech pieces.

2. A speech synthesizing method according to claim 1, in which the step of segmenting the speech waveform of each word or syllable uttered with the type-0 accent comprises the step of:

determining a length of each speech piece uttered with the type-0 accent according to a longest matching method, and the step of segmenting the speech waveform of each word or syllable uttered with the type-1 accent comprises the step of:

determining a length of each speech piece uttered with the type-1 accent according to the longest matching method.

3. A speech synthesizing method according to claim 1, wherein said step of accumulating a plurality of speech waveforms of a word or syllable comprises the steps of:

preparing a repetitious syllable sequence obtained by repeating twice a two-syllable sequence or a three-syllable sequence;

accumulating a speech waveform of the repetitious syllable sequence uttered with the type-0 accent in the waveform data base as one speech waveform of one word or syllable; and accumulating a speech waveform of the repetitious syllable sequence uttered with the type-1 accent in the waveform data base as another speech waveform of the word or syllable.

4. A speech synthesizing apparatus comprising:

a speech waveform database for storing data for a plurality of words or syllables, including for each word or syllable, a first set of data including a speech waveform of the word or syllable uttered with a type-0 accent, an accent type of the speech waveform indicating the type-0 accent thereof, a phonemic transcription of the word or syllable and one or more segmenting position information of the word or syllable, and a second set of data including another speech waveform of the word or syllable uttered with a type-1 accent, an accent type of the speech waveform indicating the type-1 accent thereof, a phonemic transcription of the word or syllable and one or more segmenting position information of the word or syllable, one of the speech waveforms of the word or syllable corresponding to a correct utterance of the word or syllable to be synthesized, and another of the speech waveforms of the word or syllable corresponding to an incorrect utterance of the word or syllable to be synthesized;

a remarked speech storing means for storing a phonemic transcription of a remarked speech to be synthesized and a remarked accent type of the remarked speech to be synthesized;

a speech piece candidate retrieving means for selecting from the speech waveform database a plurality of specific speech waveforms of specific words or syllables uttered with the type-0 accent and a plurality of specific speech waveforms of the specific words or syllables uttered with the type-1 accent according to the phonemic transcriptions of the words or syllables stored in the speech waveform database and according to the phonemic transcription of the remarked speech stored in the remarked speech storing means, segmenting each specific speech waveform according to the segmenting position information of the specific words or syllables stored in the speech waveform database to extract a plurality of speech pieces from the specific speech waveforms, and retrieving the speech pieces from the speech waveform database as candidates for a series of used speech pieces expressing the phonemic transcription of the remarked speech to be synthesized and the remarked accent type of the remarked speech;

a used speech piece determining means for determining either one of the candidates derived from the type-0 accent or one of the candidates derived from the type-1 accent as one used speech piece according to the remarked accent type of the remarked speech stored in the remarked speech storing means and according to a position of the used speech piece in the remarked speech to be synthesized for each of the used speech pieces; and a speech synthesizing means for synthesizing the remarked speech from the used speech pieces determined by the used speech piece determining means to produce the series of used speech pieces.

5. A speech synthesizing apparatus according to claim 4, wherein a speech waveform of a repetitious syllable sequence, which is obtained by repeating twice a two-syllable sequence or a three-syllable sequence, is stored in the speech waveform database by uttering the repetitious syllable sequence with the type-0 accent and by uttering the repetitious syllable sequence with the type-1 accent.

6. A speech synthesizing apparatus according to claim 5, wherein said speech waveform database is configured to store said speech waveform of the repetitious syllable sequence by storing a first speech waveform representing uttering the repetitious syllable sequence with the type-0 accent and a second speech waveform representing uttering the repetitious syllable sequence with the type-1 accent.

* * * * *